US010195536B2

(12) United States Patent
Visser et al.

(10) Patent No.: US 10,195,536 B2
(45) Date of Patent: Feb. 5, 2019

(54) METHODS, SYSTEMS, AND KITS FOR PROVIDING AN EXPERIENCE FOR A CHILD

(71) Applicants: Ellie Samantha Visser, Scottsdale, AZ (US); Mark Alan Visser, Scottsdale, AZ (US)

(72) Inventors: Ellie Samantha Visser, Scottsdale, AZ (US); Mark Alan Visser, Scottsdale, AZ (US)

( * ) Notice: Subject to any disclaimer, the term of this patent is extended or adjusted under 35 U.S.C. 154(b) by 0 days.

(21) Appl. No.: 15/385,773

(22) Filed: Dec. 20, 2016

(65) Prior Publication Data

US 2017/0173478 A1 Jun. 22, 2017

Related U.S. Application Data

(60) Provisional application No. 62/270,003, filed on Dec. 20, 2015.

(51) Int. Cl.
*A63H 9/00* (2006.01)
*A63H 33/00* (2006.01)

(52) U.S. Cl.
CPC ..... *A63H 9/00* (2013.01); *A63H 33/00* (2013.01)

(58) Field of Classification Search
CPC . A63H 3/16; A63H 9/00; A63H 33/00; A63H 33/42
See application file for complete search history.

(56) References Cited

U.S. PATENT DOCUMENTS 2,011,714 A * 8/1935 Friedman ..... A63H 33/14 273/157 R
5,522,507 A * 6/1996 Cruz ..... A61C 19/008 206/575
5,670,219 A * 9/1997 Na ..... A47G 33/08 428/133
5,712,005 A * 1/1998 Monn ..... B44C 1/105 206/223
5,725,382 A * 3/1998 Walter ..... A61F 13/551 206/459.5
5,908,108 A * 6/1999 Svopa ..... B65D 81/36 206/223
6,030,274 A * 2/2000 Kaplan ..... A63H 3/003 206/457
6,213,465 B1 * 4/2001 Jacoby ..... A63F 9/10 273/157 R (Continued)

*Primary Examiner* — Gene Kim
*Assistant Examiner* — Alyssa Hylinski

(57) ABSTRACT

Various embodiments provide methods, systems, and kits for providing an experience for a child. For example, such a system can include: a first set of instructions for a facilitator to create an experience for the user; a kit comprising a plurality of interconnecting parts configured to produce a three-dimensional model; a second set of instructions for the user to build the three-dimensional model; a certificate of completion of the experience; a wearable object signifying completion of the experience; and a container configured to hold the first and second set of instructions, the kit, the certificate of completion, and the wearable object. The three-dimensional model can be a three-dimensional likeness of a person, a fictional character, an animal, or a thing. The system can include a character communication configured to begin the experience.

4 Claims, 8 Drawing Sheets

(56) References Cited

U.S. PATENT DOCUMENTS

| | | | | |
|---|---|---|---|---|
| 6,460,193 | B1 * | 10/2002 | Di Palma | A42B 1/004 2/171 |
| 7,476,103 | B1 * | 1/2009 | Norman | G09B 23/06 434/276 |
| 8,047,375 | B1 * | 11/2011 | Hartsfield | A45C 13/02 206/581 |
| 2002/0060426 | A1 * | 5/2002 | Koenig | A63H 33/16 273/236 |
| 2002/0128081 | A1 * | 9/2002 | Clarke | A01K 5/0114 472/81 |
| 2004/0026488 | A1 * | 2/2004 | Beach | B65D 67/00 229/87.19 |
| 2006/0036224 | A1 * | 2/2006 | Suh | A61F 13/5511 604/367 |
| 2006/0046603 | A1 * | 3/2006 | Colak | A63H 3/52 446/82 |
| 2006/0116049 | A1 * | 6/2006 | Reese | A63H 33/00 446/75 |
| 2006/0207894 | A1 * | 9/2006 | Maglione | A45C 5/04 206/223 |
| 2008/0116632 | A1 * | 5/2008 | Russell | A63F 1/06 273/148 A |
| 2008/0176193 | A1 * | 7/2008 | Lucy | G09B 19/00 434/129 |
| 2009/0098800 | A1 * | 4/2009 | Duprey | A63H 33/00 446/491 |
| 2009/0215021 | A1 * | 8/2009 | Ward | G09B 19/00 434/365 |
| 2014/0124392 | A1 * | 5/2014 | Nagar | B65D 81/36 206/216 |

* cited by examiner

METHODS, SYSTEMS, AND KITS FOR PROVIDING AN EXPERIENCE FOR A CHILD

CROSS-REFERENCED APPLICATIONS

This patent application claims priority to and the benefit of provisional patent application Ser. No. 62/270,003, filed Dec. 20, 2015, entitled Methods, Systems, and Kits for Providing an Experience for a Child, which is incorporated by reference herein.

BACKGROUND

Parents are always looking for ways to entertain their children. Parents typically want experiences for their children that are both entertaining and educational. However, most parents do not have the time to plan and to gather the needed supplies to provide such experiences. In addition, most parents want to spend quality time with their children. Novel self-contained packages, which can provide children with experiences, which are both entertaining and educational that can be shared with their parent, are needed.

SUMMARY

Various embodiments provide methods, systems, and kits for providing an experience for a child. For example, such a system can include: a first set of instructions for a facilitator to create an experience for the user; a kit comprising a plurality of interconnecting parts configured to produce a three-dimensional model; a second set of instructions for the user to build the three-dimensional model; a certificate of completion of the experience; a wearable object signifying completion of the experience; and a container configured to hold the first and second set of instructions, the kit, the certificate of completion, and the wearable object. The three-dimensional model can be a three-dimensional likeness of a person, a fictional character, an animal, or a thing. The system can include a character communication configured to begin the experience. In some applications, a portion of the system can be configured as a kit.

In one example, the system can be configured to provide a child a Christmas experience. In another example, the kit can be configured to provide a child a Christmas experience. In addition, methods, as described herein, can be configured to provide a child a Christmas experience.

Methods for creating an experience for a child are provided. An exemplary method can include: a step of obtaining an experience kit; a step of reading a first set of instructions configured to create the experience; a step of delivering the experience kit to a user; a step of reading a second set of instructions with the user, wherein the second set of instruction is configured to build a model provided in the experience kit; a step of building with the user one or more of the models; a step of delivering to the user a certificate of accomplishment; and a step of delivering to the user a displayable object configured to symbolize accomplishment. The experience kit can comprise: the first set of instructions; a craft kit comprising a plurality of interconnecting parts configured to produce the three-dimensional model; the second set of instructions; a mailing container; the certificate of completion of the experience; and the displayable object signifying completion of the experience. Other variation of the experience kit can be used with the exemplary method.

Kits for creating an experience for a child are provided. An exemplary kit can include: a first set of instructions for a facilitator to create an experience for a user; a craft; a second set of instructions for the user to build the craft; a certificate of completion of the experience; and a displayable object signifying completion of the experience. The craft comprises a plurality of parts configured to interconnect to produce a three-dimensional Christmas decoration. The kit can include a collectable gift. The kit can include interactive digital content.

The kit can include a plurality of craft supplies consisting at least one of a marker, paint, a paint brush, and an adhesive. The kit can include a container configured to hold the first set of instructions, the craft, the second set of instructions, the wearable object and the certificate of completion. The kit can include a first letter from a character configured to start the experience and a second letter from a different character or the same character configured to end the experience.

These and other novel systems, methods, and kits for a facilitator to provide an experience for a user, described in detail and claimed in the following Drawings, Description, and Claims.

DRAWINGS

The present disclosure will become more fully understood from the description and the accompanying drawings, wherein.

Figure 1:
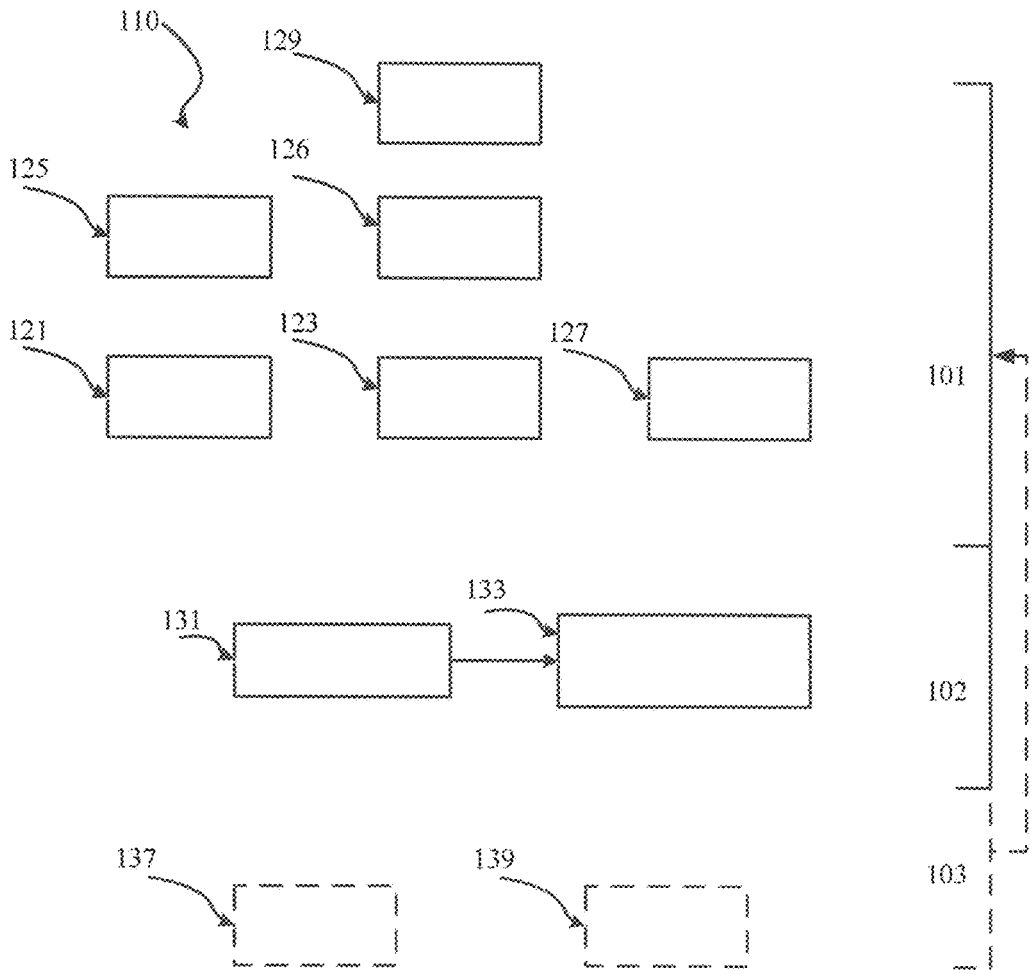
FIG. 1 is a block diagram illustrating a system and kit for providing an experience, in accordance with various embodiments.

The drawings described herein are for illustrative purposes only of selected embodiments and not all possible implementations, and are not intended to limit the scope of any of the exemplary embodiments disclosed herein or any equivalents thereof. It is understood that the drawings are not drawn to scale. Hashed lines indicate an optional element or method step. For purposes of clarity, the same reference numbers will be used in the drawings to identify similar elements.

DESCRIPTION

The following description is merely exemplary in nature and is in no way intended to limit the exemplary embodiments, their application, or uses. It should be understood that steps within a method may be executed in different order without altering the principles of the present disclosure. For example, various embodiments may be described herein in terms of various functional components and processing steps. It should be appreciated that such components and steps may be realized by any number of hardware components configured to perform the specified functions.

Various embodiments provide self-contained systems for providing an experience to a child. In addition, various embodiments provide methods for providing an experience to a child. Some embodiments provide kits configured for providing an experience to a child.

Now with reference to FIG. 1, a block diagram illustrates various elements for a system 110 for providing an experience for a child. The system 110 can comprise an experience kit 101 (as described below), packaging 102, and optional character communications 103.

In some embodiments, the experience kit 101 can comprise a first set of instructions 121, a craft kit 125, a second set of instructions 123, a mailing container 129, a certificate of completion 126, and a displayable object 127. The experience kit 101 can further comprise stationary, such as a notepad, greeting cards, or fancy paper, and may comprise a writing utensil, such as a pen, pencil, or marker. The craft kit 125 comprising a plurality of interconnecting parts configured to produce a three-dimensional likeness of a person, a fictional character, an animal, or a thing. The second set of instructions 123 can be configured for a user to build the three-dimensional likeness of a person, a fictional character, an animal, or a thing. In some embodiments, the experience kit 101 comprises at least two of the three-dimensional likeness of a person, a fictional character, an animal, or a thing. For example, the experience kit 101 can include multiple craft kits 125, and in some of these examples, the multiple craft kits 125 are identical.

In some embodiments, an experience kit 101 can include a first set of instructions 121 for a facilitator to create an experience for a user; a craft 125; a second set of instructions for the user to build the craft 125; a certificate of completion 126 of the experience; a displayable object 127 signifying completion of the experience; and a mailing container 129 configured to send one or more of the completed crafts 125 to a charity. The craft 125 can be any craft known to those skilled in the art. For example, the craft 125 can be a model, which requires assembly. A displayable object can any type of object having written text on it that indicates that the user participated in the experience. For example, the displayable object can be a bracelet or a wristband. In another example, the displayable object can be a figurine or a trophy. A displayable object can be a wearable object.

The packaging 102 includes a container 131 and a decoy 133. In one embodiment of the system 110, the packaging 102 includes only the container 131. The container 133 is configured to hold the parts of the experience kit 101. The container 131 can be configured to fit inside the decoy 133. For example, the decoy 133 can be a sleeve which wraps around the container 131 to conceal any description of the container 131. The decoy 133 is designed to hide the container 133 from the user (such as a child) upon delivery of the system 110 to a facilitator (such as a parent).

The optional character communications 103 can be any communication from a character in the experience. The character communications 103 can be a note or a letter, an audio recording, an interactive digital book, and/or a video recording. Such character communications can be in paper form, an analog recording or a digital format. In an example, the character communications 103 can comprise a first letter 137, which is configured to begin the experience, and a second letter 139, which is configured to end the experience. In another example, the character communications 103 can comprise a first letter 137 from a character, which is configured to begin the experience, and a certificate of completion 126 from the character, which is configured to end the experience. The character communications 103 can comprise a recording configured to begin the experience and a video configured to end the experience. Of course, the character communications 103 can be of any number and can be from only one character or from any number of different characters. In addition, the character communications 103 can be in any combination of formats. In some embodiments, one or more of the character communications 103 are part of kit 101, as indicated by hashed line in FIG. 1.

Figure 2:
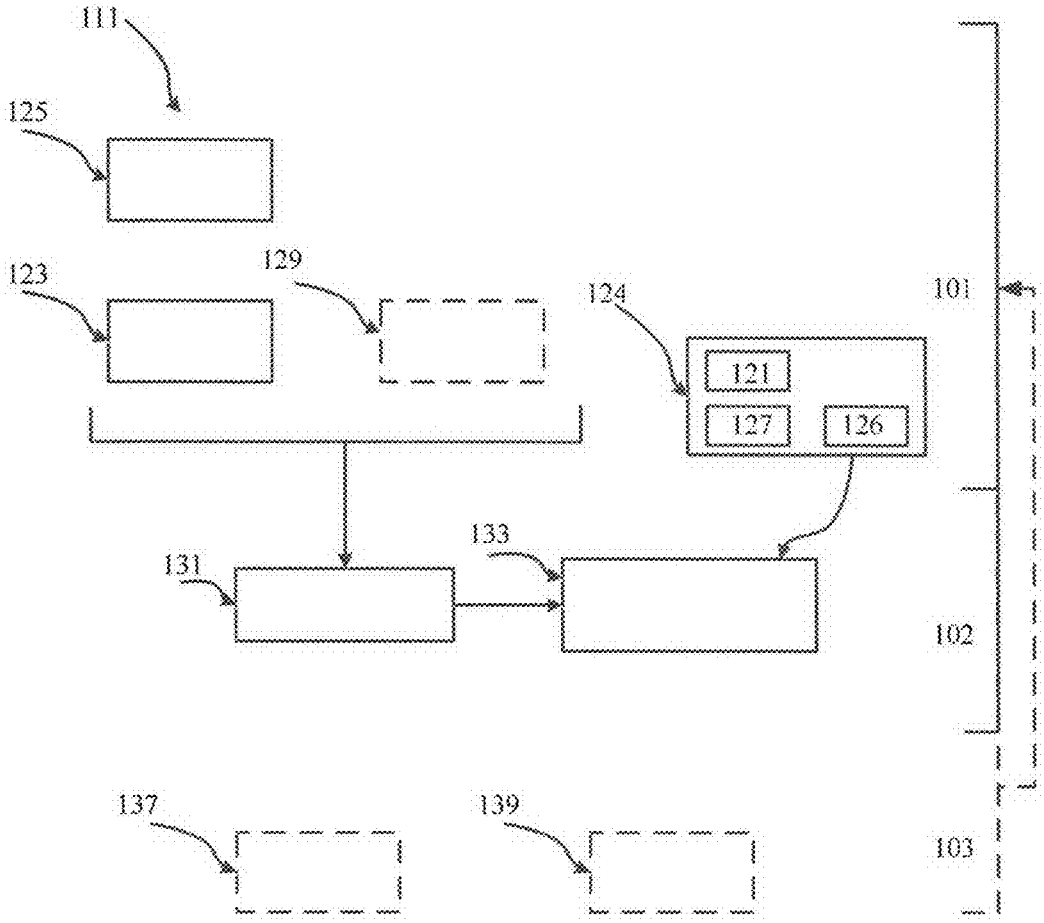
FIG. 2 is a block diagram illustrating an alternative system and kit for providing an experience, in accordance with various embodiments.

With reference to FIG. 2, a block diagram illustrates various elements for an alternate system 111 for providing an experience for a child. The alternate system 111 can comprise an experience kit 101 (as described below), packaging 102, and optional character communications 103. In the alternate system 111, the experience kit 101 can comprise a second set of instructions 123, a craft kit 125, facilitator packet 124. In some configurations, the experience kit 101 comprises an optional mailing container 129. The facilitator packet 124 comprises the first set of instructions 121. The facilitator packet 124 can comprise a certificate of completion 126, and a displayable object 127. An example of the displayable object 127 is a bracelet. The facilitator packet 124 can comprise other items, which can be used to provide the user the experience. For example, the facilitator packet 124 can comprise props to be positioned on or around the experience kit 101 before the user finds the experience kit 101; such props can add to the experience for the user. In addition, the facilitator packet 124 can comprise one or more costumes, which can be incorporated into the experience.

The alternative system 111 comprises a container 131 and a decoy, both as described above. The facilitator packet 124 can be outside of container 131 and can be located within the decoy 133. The alternative system 111 can comprise one or more character communications 103. In an example, the character communications 103 can comprise a first letter 137, which is configured to begin the experience, and a second letter 139, which is configured to end the experience. In another example, the character communications 103 can comprise only a first letter 137 from a character, which is configured to begin the experience. In some embodiments, one or more of the character communications 103 are part of kit 101.

Figure 3:
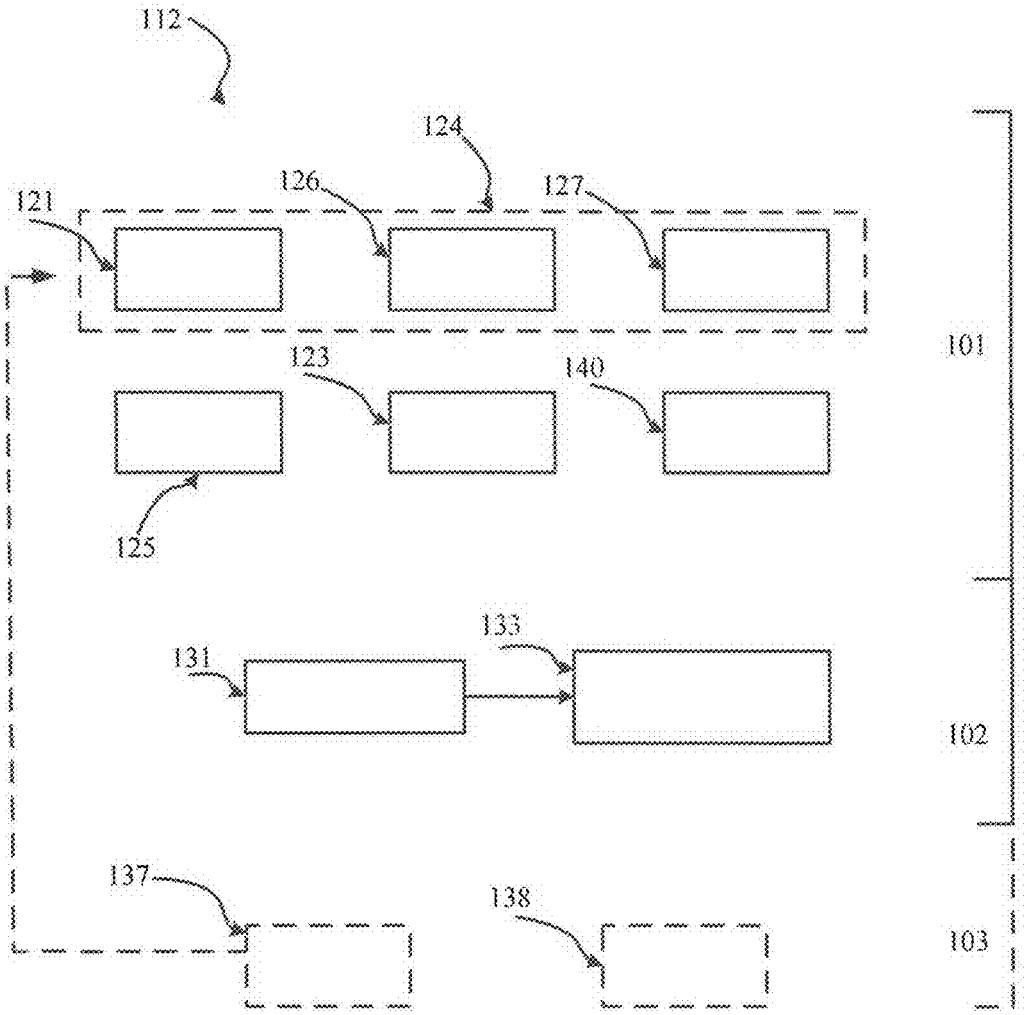
FIG. 3 is a block diagram illustrating a second alternative system and kit for providing an experience, in accordance with various embodiments.

Moving to FIG. 3, a block diagram illustrates various elements for a second alternate system 112 for providing an experience for a child. The second alternate system 112 can comprise an experience kit 101 (as described below), packaging 102, and character communications 103.

In the second alternate system 112, the experience kit 101 can comprise a first set of instructions 121, a craft kit 125 (for example, as described herein), a second set of instructions 123, a gift 140 for the user, a certificate of completion 126, and a displayable object 127. In some configurations, the certificate of completion 126, and the displayable object 127 are packaged together. In some configurations, the first set of instructions, the certificate of completion 126, and the displayable object 127 are packaged together in the facilitator packet 124. The experience kit 101 can further comprise stationary, such as a notepad, greeting cards, or fancy paper, and may comprise a writing utensil, such as a pen, pencil, or marker.

The packaging 102 can include a container 131 and a decoy 133. In one embodiment of the second alternative system 112, the packaging 102 includes only the container 131. The container 133 is configured to hold the parts of the experience kit 101. The container 131 can be configured to fit inside the decoy 133. For example, the decoy 133 can be a sleeve which wraps around the container 131 to conceal any description of the container 131. The decoy 133 is designed to hide the container 133 from the user (such as a child) upon delivery of the system 110 to a facilitator (such as a parent).

The second alternative system 112 can comprise one or more character communications 103. In an example, the character communications 103 can comprise a first letter 137, which is configured to begin the experience, and a digitally formatted content 138, which can be configured as a learning tool for the experience. For example, the digitally formatted content 138 is made available on a website. The digitally formatted content 138 can be view in the website or downloaded and viewed at a later time. In another example, the digitally formatted content 138 is on electronically readable media, which can be included in the experience kit 101. In some experiences, the digitally formatted content 138 can be an interactive electronic book. In some experiences, the digitally formatted content 138 can a short movie or video. In some experiences, the digitally formatted content 138 can be an interactive game or puzzle. For example, digitally formatted content 138 can be any piece of media, which is stored (as part of kit 101) or is obtained from a website, a server, or the Cloud. As will be appreciated by one of skill in the art, the type content that can be included in digitally formatted content 138 is endless and of course more than one item can be included in digitally formatted content 138. In another example, the character communications 103 can comprise only a first letter 137 from a character, which is configured to begin the experience. In some embodiments, one or more of the character communications 103 are part of kit 101. In some embodiments, one or more of the character communications 103 can be part of the facilitator packet 124.

Figure 4:
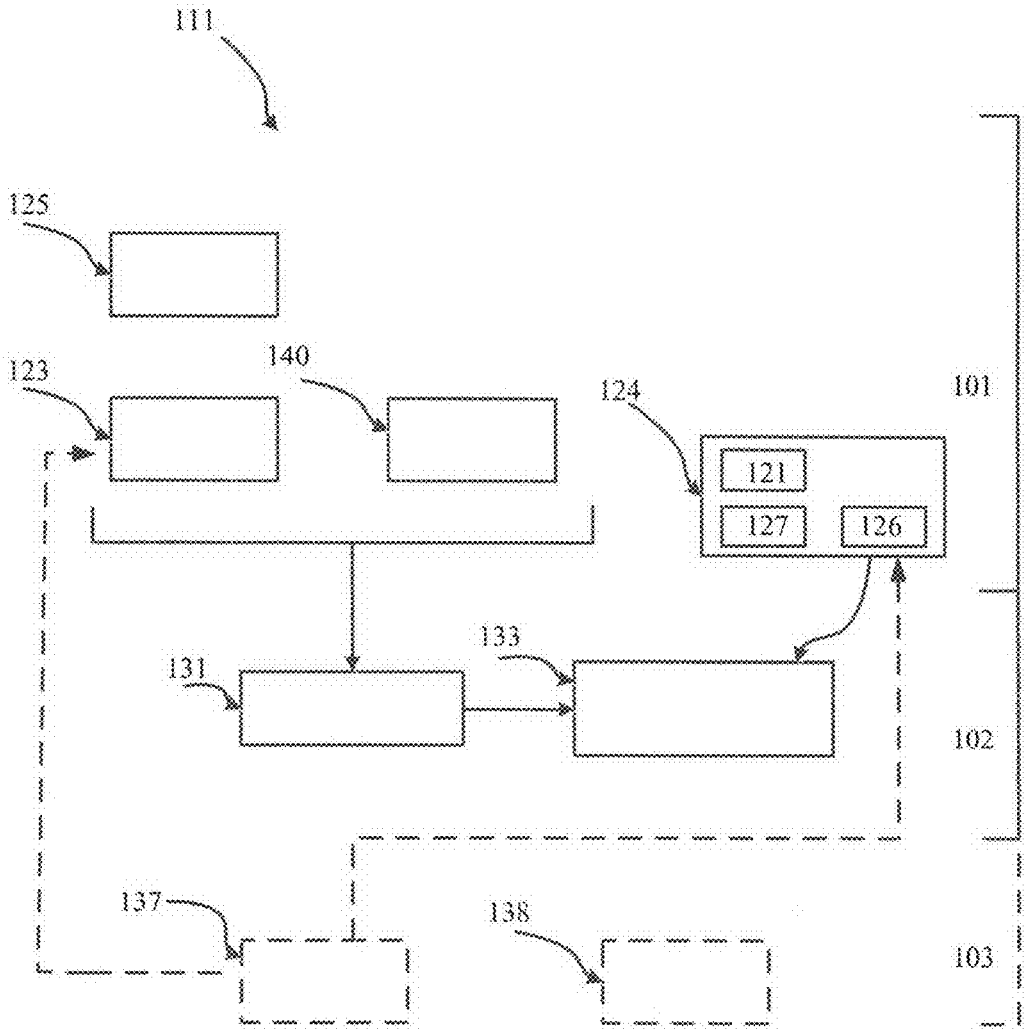
FIG. 4 is a block diagram illustrating a third alternative system and kit for providing an experience, in accordance with various embodiments.

Turning to FIG. 4, a block diagram illustrates various elements for a third alternate system 113 for providing an experience for a child. The third alternative system 113 can comprise an experience kit 101 (as described below), packaging 102, and character communications 103. In the alternate system 111, the experience kit 101 can comprise a first set of instructions 121, In the alternate system 111, the experience kit 101 can comprise a second set of instructions 123, a craft kit 125, a user gift 140 and a facilitator packet 124, which comprises a first set of instructions 121. The facilitator packet 124 can comprise a certificate of completion 126, and a displayable object 127. However, the certificate of completion 126, and/or the displayable object 127 can be included as separate items in the experience kit 101. As discussed above, the facilitator packet 124 can comprise other items, which can be used by the facilitator to provide the experience to the user. For example, the facilitator packet 124 can comprise props to be positioned on or around the experience kit 101 before the user finds the experience kit 101, and/or can comprise one or more costumes, which can be incorporated into the experience.

The third alternative system 113 comprises a container 131 and a decoy, both as described above. The facilitator packet 124 can be outside of container 131 and can be located within the decoy 133. The third alternative system 113 can comprise one or more character communications 103. In an example, the character communications 103 can comprise a first letter 137, which is configured to begin the experience, and a digitally formatted content 138, which can be configured as a learning tool for the experience, as described above. In some embodiments, one or more of the character communications 103 are part of kit 101. In some embodiments, one or more of the character communications 103 can be part of the facilitator packet 124.

A method of providing an experience can include the following steps: A facilitator obtains an experience kit, such as, for example, experience kit 101, as described herein. The facilitator reads a set of facilitator's instructions on how to create the experience. In some aspects, the facilitator opens a facilitator packet, which comprises the facilitator's instructions, a certificate of completion, a wearable object, and a mailing label addressed to a charity. The facilitator packet can also comprise various other items that have been created the experience, such as those discussed above. The facilitator delivers at least a portion of the kit to a user as described in the facilitator's instructions.

The method can further include: a step of the user receiving and opening the kit. In an optional step, the user can receive a first communication from a character, which is configured to start the experience for the user. The user can read the instructions to build the craft contained in the kit. The user (in some examples, with the assistance of the facilitator) builds the craft. The facilitator and the user learn about the charity and how to give to the charity. The user and the facilitator package at least one completed item from the craft kit and send it to the charity. In an optional step, the user writes a letter to a person who will receive the completed item and includes the letter in the package sent to the charity. The facilitator sends the package to the charity. The facilitator delivers a certificate of completion and a wearable object signifying accomplishment. In an optional step, the user can receive a second communication from a character, which is configured to end the experience for the user. In an example, the second communication can thank the user for sending his/her gift to the charity. In the final step, the user receives the certificate and the wearable object signifying accomplishment.

In some embodiments, the method can comprise the following steps: The facilitator purchases and receives a kit. The facilitator reads creation experience instructions. The facilitator alerts user (builder) that fictional character will be visiting with a special job for them to help fictional character. The facilitator explains reason the user is helping fictional character. The facilitator incorporates a charity component and theme of giving back. The facilitator places the toolkit at a delivery site and alerts user. The user retrieves the toolkit. The facilitator reads fictional character greeting, such as, a first character communication, to the user. The facilitator works with the user to construct craft and complete generic card notes. The facilitator further elaborates on who will be receiving their craft and why their job is so special. The facilitator helps user repackage toolkit with completed craft. The facilitator alerts the user that the fictional character will be returning to pick up completed craft. The user leaves the toolkit at original delivery site for pick-up by the character. The facilitator retrieves the toolkit from delivery site without user's knowledge. The facilitator ships package to the charity using pre-addressed return label. The facilitator presents the user with a character thank you (a second character communication), which includes an Official Completion Certificate and a bracelet.

Figure 5:
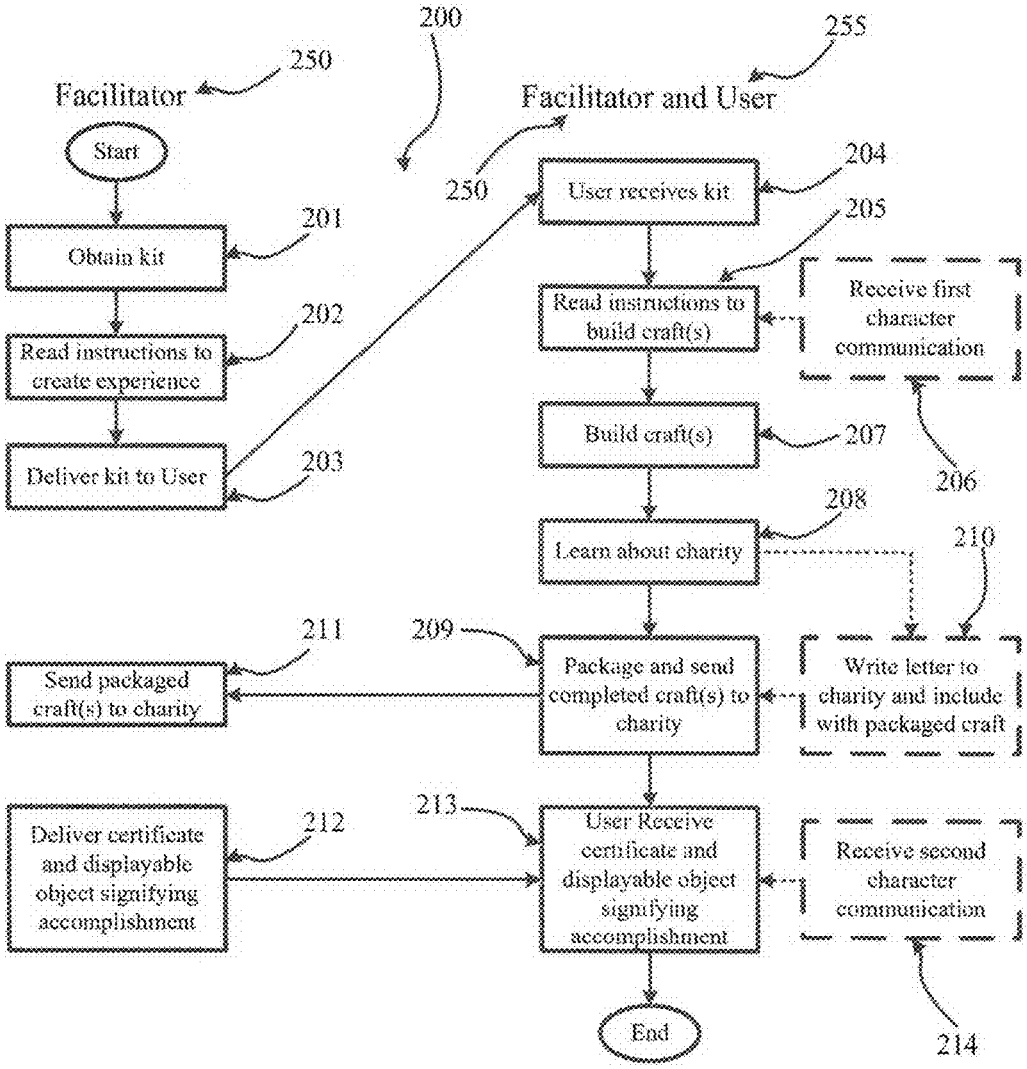
FIG. 5 is a flowchart illustrating an example of a method for providing an experience, in accordance with various embodiments.

As illustrated in FIG. 5, a method 200 for creating an experience for a user 255 (such as, for example, a child) can include that following steps: a step 201 of a facilitator 250 obtaining an experience kit 101. The method 200 can further include a step 202 of reading first set of instructions configured to create the experience. The method 200 can include a step 203 of delivering at least part of the experience kit 101 to a user 255. The method 200 can include a step 204 of the user 255 receiving the experience kit 101. The method 200 can include a step 205 of reading the second set of instructions with the user 255, wherein the second set of instruction is configured to build the craft kit. The method 200 can include a step 207 of building with the user 255 one or more craft kits from the experience kit 101. The method 200 can include a step 209 of packaging with the user 255 at least one completed craft kit into the mailing container. The method 200 can include a step 211 of sending the mailing container to the charity. The method 200 can include a step 212 of delivering to the user a certificate of accomplishment and/or a wearable object configured to symbolize accomplishment. The method 200 can include a step 213 of the user 255 receiving the certificate of accomplishment and/or the wearable object configured to symbolize accomplishment.

The method 200 can include one or more of the following optional steps. The method 200 can further include a step 206 of reading with the user 255 a first letter configured to frame the experience and to begin the experience, wherein the step 206 of reading the first letter is after the step 204 of delivering the experience kit to the user 255. The method 200 can include a step 208 wherein the facilitator 250 and the user 255 learn about the charity and how to give to the charity. The method 200 can include the step 210 of writing a letter to the charity and including it in the mailing container. The method 200 can include a step of placing with the user 255 the mailing container (with a shipping label) in a location for delivery to a charity. The method 200 can further include a step 214 of reading with the user a second letter configured to laud accomplishment on the user and to end the experience, wherein the reading of the second letter is before or simultaneously with at least one of the step 213 of delivering the certificate and/or the displayable object.

Figure 6:
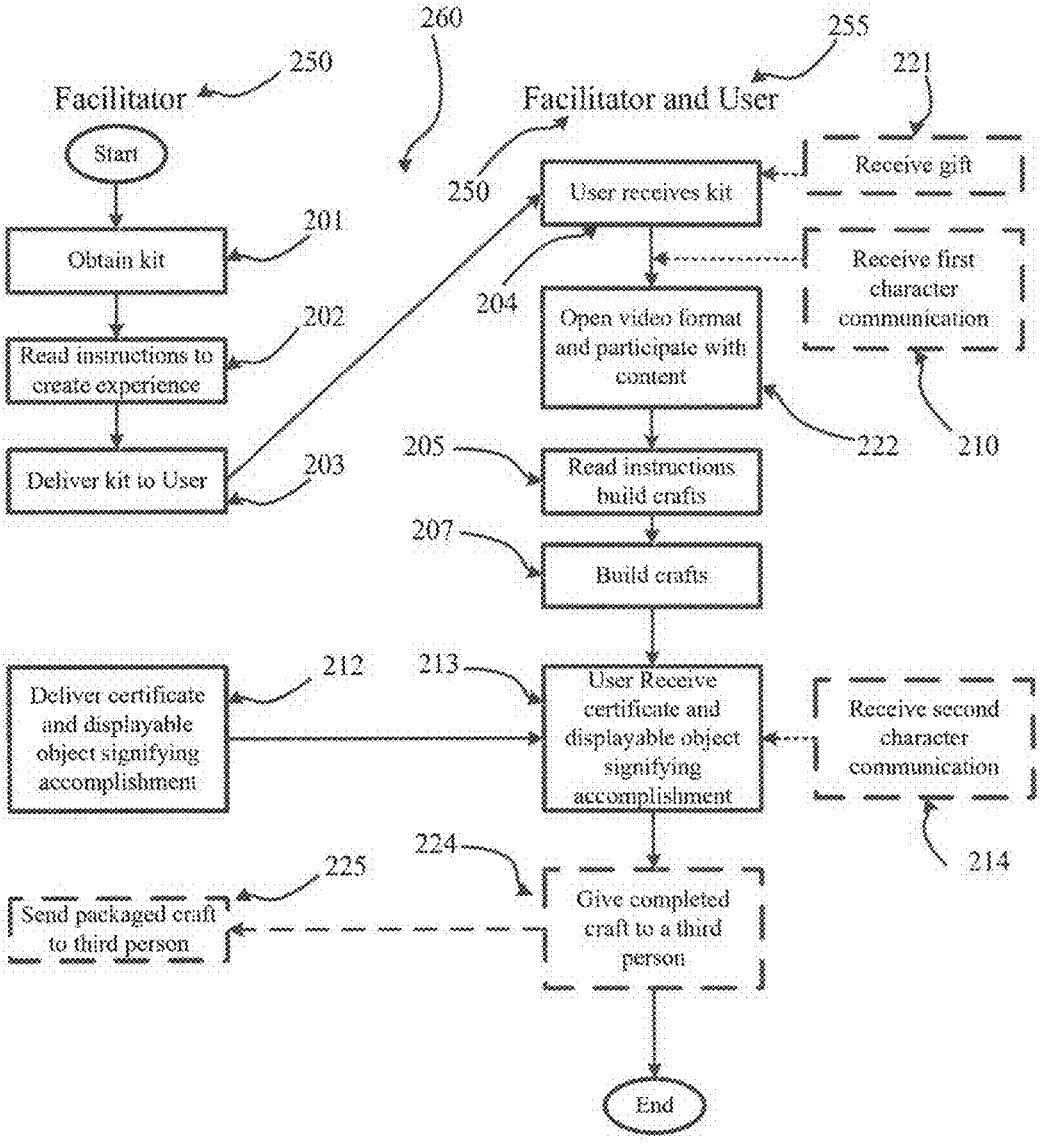
FIG. 6 is a flowchart illustrating another example of a method for providing an experience, in accordance with various embodiments.

Turning to FIG. 6, a method 260 for creating an experience for a user 255 (such as, for example, a child) can include that following steps: a step 201 of a facilitator 250 obtaining an experience kit 101. The method 260 can further include a step 202 of reading a first set of instructions configured to create the experience. The method 260 can include a step 203 of delivering at least part of the experience kit 101 to a user 255. The method 260 can include a step 204 of the user 255 receiving the experience kit 101. The method 260 can optionally include the step 221 of the user 255 receiving a gift included in the experience kit 101. The method 260 can further include a step 210 of reading with the user 255 a first letter configured to frame the experience and to begin the experience. The step 206 of reading the first letter can be during or after the step 204 of delivering the experience kit to the user 255. The step 221 of the user 255 receiving a gift can be during or after the step 204 of delivering the experience kit to the user 255.

Method 260 can include a step 222 of accessing digitally formatted content and the user 255 participating with the content. In some experiences, the content can be an electronic book, which the user 255 reads and interacts with it. In some experiences, the content can a short video, which the user 255 watches and learns for it. In some experiences, the content can be an interactive game or puzzle, which the user 255 plays the game or solves the puzzle. The step 222 can include accessing multiple pieces in the content and the multiple pieces can be different types of content.

The method 260 can include a step 205 of reading the second set of instructions with the user 255, wherein the second set of instruction is configured to build the craft kit. The method 260 can include a step 207 of building with the user 255 one or more craft kits from the experience kit 101. The method 260 can optionally include a step of the user 255 selecting at least one completed craft kit and giving it to a third person. Examples of such a third person can include, but are limited to, a parent, a grandparent, a family member, a friend, a person in need, or a gift exchange. In addition, the user 255 can write and/or draw on the note cards and include the completed cards with the giving to the third person. The method 260 can include a step 212 of delivering to the user a certificate of accomplishment and/or a displayable object configured to symbolize accomplishment after the giving to third person. The method 260 can include a step 213 of the user 255 receiving the certificate of accomplishment and/or the displayable object configured to symbolize accomplishment. The method 260 can further include a step 214 of reading with the user a second letter configured to laud accomplishment on the user and to end the experience, wherein the reading of the second letter is before or simultaneously with at least one of the step 213 of delivering the certificate and/or the displayable object. In some experiences, the user 255 receives the certificate and displayable object upon placing completed crafts and note cards in the toolkit for the fictional character to "check," which can be the second communication. Then the user 255 would proceed to receive the items and deliver their crafts and cards to the third person. The method 260 can optionally include a step 224 of the user 255 selecting at least one completed craft kit and giving it to a third person.

In various embodiments, the systems and methods are not limited to building a craft. Instead, some experiences provide a first set of instructions for doing a task with the user and the kit has the appropriate items for such a task. Similarly, some experiences provide a first set of instructions for performing an activity with the user and the kit has the appropriate items for such an activity. For example, an activity can be a role play based on a scenario described in the first set of instructions. In addition, some experiences provide a first set of instructions for solving one or more puzzles or problems with the user and the kit has the appropriate items. Of course, some experiences provide a first set of instructions, which can be any combination of tasks, activities, and/or solving puzzles or problems.

In various embodiments, the system can be configured for various events. For example, system can be configured for the Christmas experience. In other examples, system and/or kit can be configured for a birthday, Hanukkah, a bridal shower, bachelorette party, Easter, and other such events. In some embodiments, system can be configured for a subscription-type delivery. For example, system can be delivered on a cyclic basis, such as, on a monthly, on a bimonthly, or on a weekly basis. An example of a December system can be configured for Christmas, as discussed herein. In a birthday month of the subscriber, the system can be configured for a birthday. In some embodiments, the system and method are configured for example for educational purposes. In some examples of subscriptions, the system can be configured to be to have an animal theme and the charity is a wildlife non-profit. In another month, the theme could be global warming/climate change and the charity is an environmental non-profit. In still another month, the theme could be oceans and the charity could be Greenpeace or another non-profit serving oceanic causes. For example, the charity may be just informational. Another example, the experience includes collecting information and sending it to the charity.

Non-Limiting Examples

In one example of a Christmas experience kit can include a first set of instructions for a facilitator to create the Christmas experience for a child; a craft comprising a plurality of parts configured to interconnect to produce a three-dimensional Christmas decoration; a second set of instructions for the user to build the craft; a certificate of completion of the experience; a wearable object signifying completion of the experience; and a mailing container configured to send a completed Christmas decoration to a charity. The kit can comprise various supplies for building the craft, such as, for example, a marker, paint, a paint brush, and an adhesive. The wearable object can be a wristband comprising at least one logo and at least one word indicating the completion of the experience. The kit can include a first communication from the North Pole, such as, from Santa or an elf, configured to start the experience and a second communication from the North Pole configured to end the experience. The kit can include a notepad. The kit can include information about the charity in a pamphlet, audio recording, and/or a digital format.

A Christmas experience system can comprise: a container, a decoy, facilitator instructions (a first set of instructions), craft assembly instructions (second set of instructions), digitally formatted content that is either on electronic readable media, or is downloadable from a website, or is steamtable form the Cloud, an official certificate for being Santa's Little Helper, a bracelet signifying accomplishment, a user gift, note cards, letter from the North Pole, at least one marker or other type of writing utensil, at least one paint brush, a plurality of paints in different colors, an adhesive, and a craft kit comprising a plurality of interconnecting parts configured to produce a three-dimensional model. In one embodiment, the craft kit comprises reindeer forms, eye pieces, antlers, noses, glitter, and ribbon with bells.

The gift 140 can be a mascot, a token, or a keepsake, which supports the fantastical elements of the experience, and increases the child's feeling of belonging to it and participating in the process. In some experiences, the gift is a Christmas ornament. As part of the experience, a child gets to hang the ornament up as a reminder of whose team they've been recruited to be on (Santa's) and their special role in helping him and doing special things for others Packaging can include a sleeve (such as a decoy, as discussed herein) for internal box (such as a container, as discussed herein) to fit into. In one application, the internal box can have the dimensions of 7.5H×7.5L×3W. The sleeve will wrap around internal box can serve a dual purpose of tool kit and of shipping container to a third person. The exterior of the sleeve can include branding/messaging on the product. The primary of the audience of this will be the purchaser/facilitator of the product. The exterior of the interior box can include branding/messaging and logo. For example, the branding/messaging and logo can include a North Pole stamp and Santa's little helper _____ (child's name written in by facilitator to appear the kit is specifically designed for that child). The primary audience of this will be the user/builder of the craft.

Figure 7:
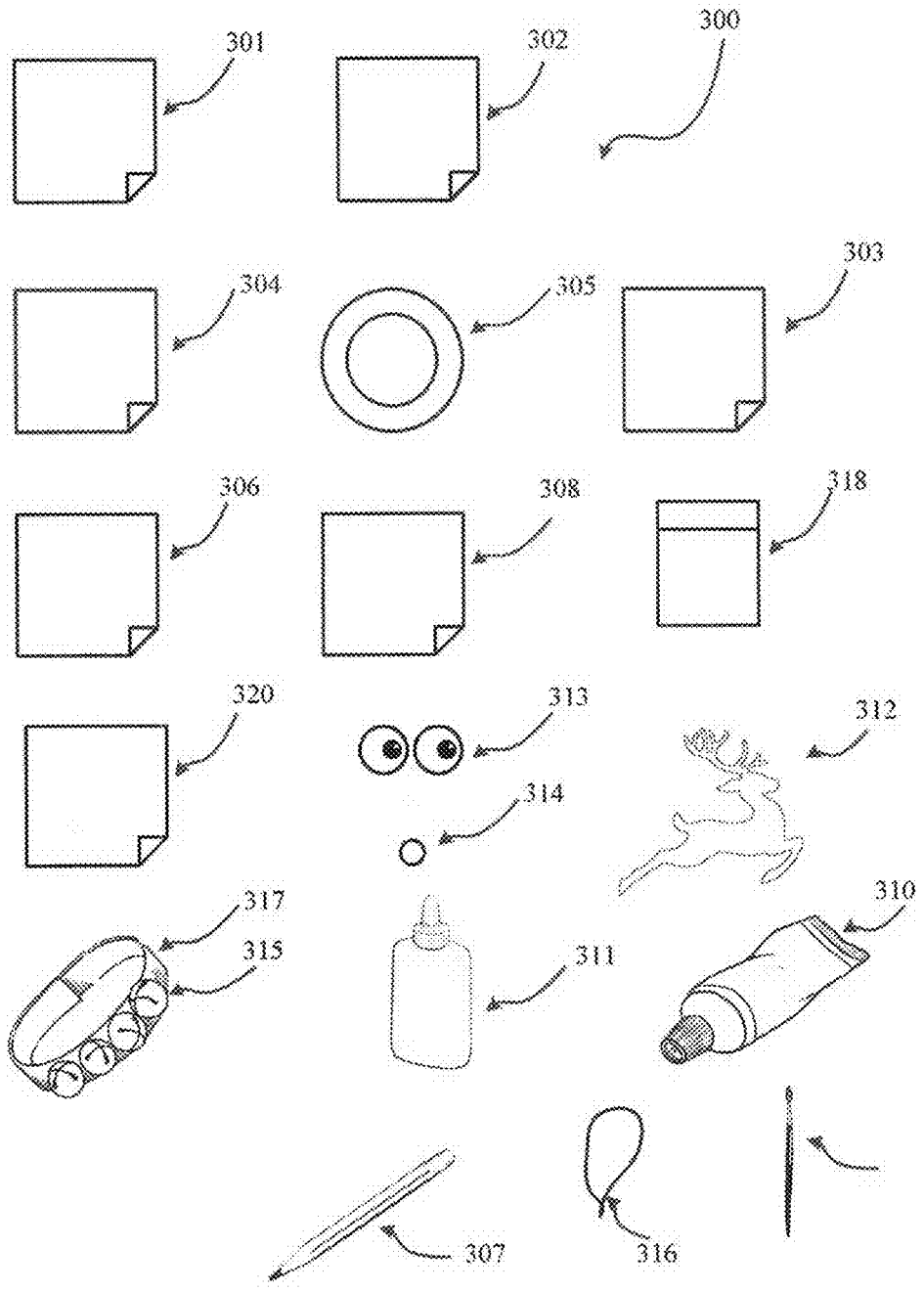
FIG. 7 is a schematic illustrating an exemplary system for providing a Christmas experience, in accordance with various embodiments.

As illustrated in FIG. 7, an exemplary system 300 can comprise: facilitator instructions 301 (first set of instructions), a shipping label 302 addressed to the charity, a thank you note 303 from the north Pole (Santa or elf) (second set of instructions), an official certificate 304 for being Santa's Little Helper, a bracelet 305 signifying accomplishment (displayable object), a note pad 306—for the child to write note to recipient of the craft, a note 308 from the elf, at least one writing utensil 307, at least one paint brush 309, a plurality of paint colors 310, an adhesive 311, reindeer forms 312, eye pieces 313, ornament loop 316, nose 314, glitter 318, and harness 317 with bells 315. Examples of materials for harness 317 include, but are not limited to, ribbon, paper, cloth, leather, and pipe cleaners. As discussed herein, the system 300 can include multiples of the same parts for the craft, so that multiple crafts can be built and painted. For example, the system 300 can include 8 reindeer forms 312, 8 sets of eye pieces 313, 8 ornament loops 316, 8 noses 314, and 8 harness 317 with bells 315. Of course, this is only an example and any number of the same parts could be used.

The facilitator instructions can be configured to instruct the facilitator on how to create the experience, how to construct craft, and how to ship the completed craft to the charity.

For example, the facilitator instructions can include the following:

1. Locate and set aside the shipping label, North Pole Thank You Letter, Certificate and Bracelet. You will need these upon completion of the craft to complete the experience and ship the ornaments.

2. Remove glitter container from kit and place North Pole Greeting Letter on top of contents. Close kit.

3. Begin building delivery anticipation:

a. Notify builder that Santa is extra busy in his workshop and has an extra special project he needs their help with.

b. Tell them his elf will be visiting their neighborhood in a few days' time and will drop off their Toolkit then.

4. Deliver package without builder's knowledge. Ensure builder is unaware of your activity before starting this process.

a. Determine delivery site where builder will retrieve delivered package from elf.

b. Write builder's name on name line of Toolkit package. We recommend altering your everyday handwriting to further enhance experience and make builder believe elf wrote their name.

c. Sprinkle Santa's Snowdust on ground of delivery site (optional).

d. Place Toolkit on top of Santa's Snowdust.

e. Ring doorbell or knock on front door of house.

f. Tell builder someone is at the door, and that it may be Santa's elf with their package. Have them go to door and answer it.

g. Have builder retrieve Toolkit.

5. Choose a date that the elf will return to the neighborhood to collect the finished kit. Assist builder to complete the craft before that date.

6. Read builder the Elf Greeting note and assist them with the craft (See Craft Instructions). Share about the reason they're making this craft, writing their notes, and helping Santa this year. Discuss the special people they are giving back to.

7. Place the completed reindeer ornaments and builder's Christmas Cheer Cards back in the Toolbox.

8. Have builder set Toolkit at package's original delivery site on the night before the day you selected for Santa's elf to visit again and pick it up. When the builder is not aware (i.e.: after they have gone to bed), retrieve the box to ship.

9. Write builder's name on Certificate in space provided.

10. The day after Toolkit is placed on front porch, give builder their Official Santa's Little Helper Certificate and bracelet.

11. Ship package using pre-addressed shipping label (optional).

12. Craft Instructions are illustrated in a separate pamphlet.

13. Certificate: Congratulations! You are officially Santa's Little Helper! You made Christmas extra special this year for many people. Thank you for your good work and helping Santa and his elves! Merry Christmas!

Enjoy completing this craft kit, knowing that it will not only provide a rich experience for you and your builder, but also bring encouragement and hope to those in need around the world. Through our partnerships with charities, we are making it easy for families to give back this Christmas season. The charities we work with will ensure that your contributions are given to those who need it most. Merry Christmas, from us to you, and you to the world. Santa's Little Helper is about bringing meaning back to Christmas as families, children, and charity come together. We love being part of the greater themes of this special holiday: joy, blessings, giving, hope, and family. Please take care to explain to your child the reason they are helping Santa, and the special people he is bringing their ornaments and notes to.

Figure 8:
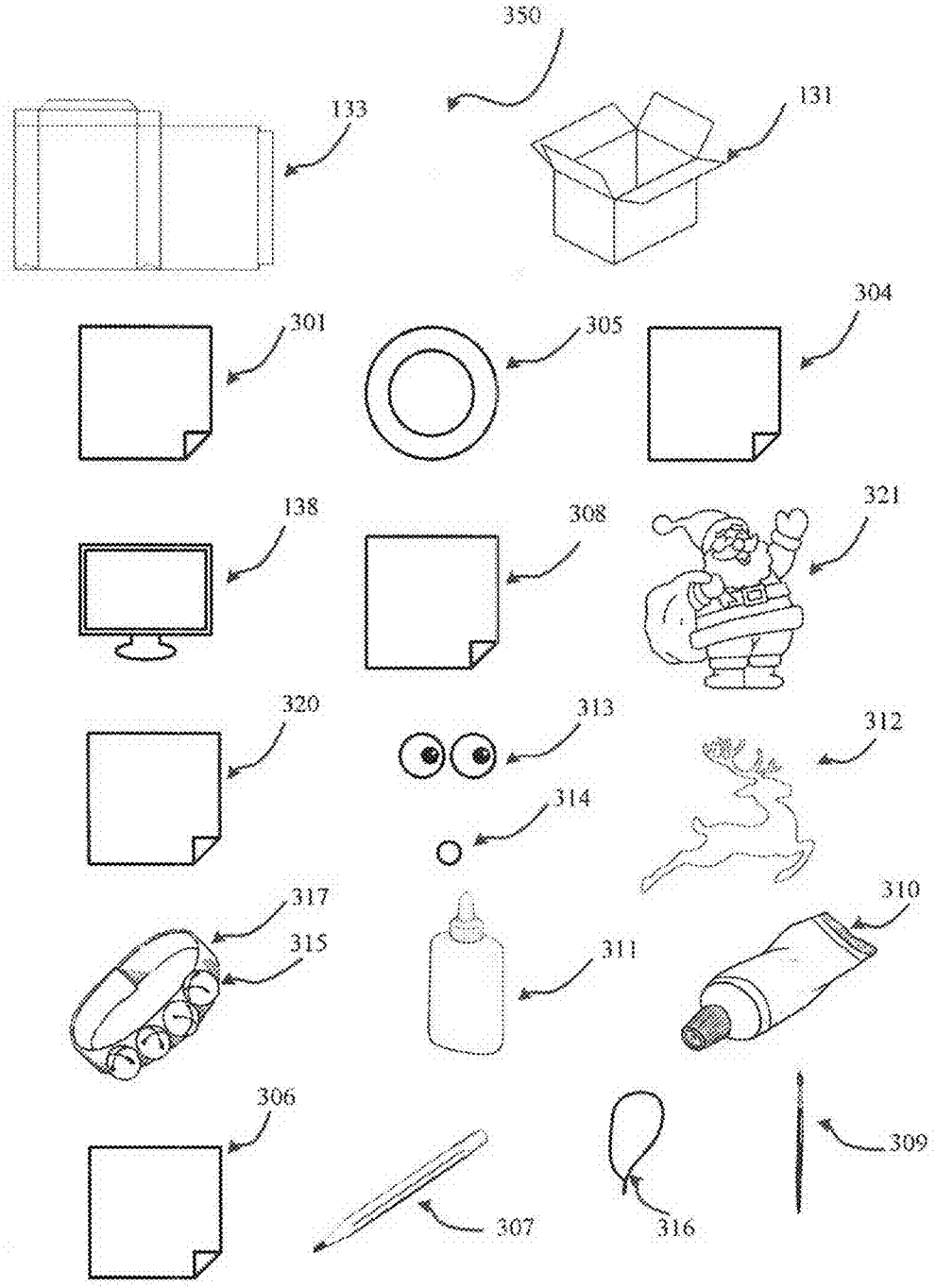
FIG. 8 is a schematic illustrating an alternative exemplary system for providing a Christmas experience, in accordance with various embodiments.

As illustrated in FIG. 8, an alternative exemplary system 350 can comprise: container 131, decoy 133, facilitator instructions 301 (first set of instructions), craft assembly instructions 320 (second set of instructions), an official certificate 304 for being Santa's Little Helper, a digitally formatted content 138, a bracelet 305 signifying accomplishment (displayable object), user gift 321, a note cards 306, a letter 308 from north pole, at least one writing utensil 307, at least one paint brush 309, a plurality of paint colors 310, an adhesive 311, reindeer forms 312, eye pieces 313, ornament loop 316, nose 314, and harness 317 with bells 315. Examples of materials for harness 317 include, but are not limited to, ribbon, paper, cloth, leather, and pipe cleaners. As discussed herein, the system 300 can include multiples of the same parts for the craft, so that multiple crafts can be built and painted. For example, the system 300 can include 8 reindeer forms 312, 8 sets of eye pieces 313, 8 ornament loops 316, 8 noses 314, and 8 harness 317 with bells 315. Of course, this is only an example and any number of the same parts could be used.

An exemplary method of providing a Christmas experience for a child can include the following steps: a facilitator obtains a Christmas experience kit. The facilitator reads a set of facilitator's instructions on how to create the experience. In some aspects, the facilitator opens a facilitator packet, which comprises the facilitator's instructions, a certificate of completion, and a bracelet. The facilitator packet can also comprise various other items needed to create the experience. The facilitator delivers a tool kit from the Christmas experience kit to the child, as described in the facilitator's instructions. In an example, the facilitator places the tool kit on the doorstep of the child's home.

The exemplary method can further include: a step of the child finding the tool kit on the doorstep and opening the tool kit. The child can receive a first communication from an elf, which is configured to start the Christmas experience for the child. Along with the first communication. The child receives a gift, which can be but is not limited to a collectable toy, Christmas decoration, a piece of electronics with content loaded on it, a gift card, or the like. The child can read the instructions to build the crafts contained in the kit. The child (in some examples, with the assistance of the facilitator) builds the crafts. The facilitator downloads video formatted, as instructed in the facilitator instructions. The facilitator and the child learn about giving from the digitally formatted content. The child selects at least one completed item from the craft kit and gives it to a third person. The child writes a letter to a person who will receive the completed item and includes the letter in the package sent to the third person. The facilitator delivers a certificate of completion and a wearable object signifying accomplishment. In the final step, the user receives the certificate and the wearable object signifying accomplishment.

Another exemplary method can comprise: a step of obtaining an experience kit comprising a model; a step of reading a first set of instructions configured to create the experience; a step of delivering the experience kit to a user; a step of reading a second set of instructions with the user, wherein the second set of instruction is configured to build the craft kit; a step of building with a user one or more of the models; a step of delivering to the user certificate of accomplishment; and a step of delivering to the user a displayable object configured to symbolize accomplishment.

The experience kit can include a first set of instructions; the craft kit comprising a plurality of interconnecting parts configured to produce the three-dimensional model; a gift for the user; the second set of instructions; the certificate of completion of the experience; and the displayable object signifying completion of the experience.

The method can include a step of downloading digitally formatted content and having the user participate with the content on an electronic device. The method can include a step of reading with the user a first letter configured to frame the experience and to begin the experience, wherein the step of reading the first letter is after the step of delivering the experience kit to the user. The method can include a step of reading with the user a second letter configured to laud accomplishment on the user and to end the experience, wherein the reading of the second letter is before or simultaneously with at least one of the step of delivering the certificate and the step of delivering the wearable object. The user learns about giving and about their special role relating to the experience through the digitally formatted content.

The method can include the following multiple steps: a step of packaging with the user at least one completed model into the mailing container; a step of placing with the user the mailing container in a location for delivery to third person, wherein the mailing container contains the at least one completed model; and a step of sending the mailing container to the third person.

As used herein, the phrase "at least one of A, B, and C" can be construed to mean a logical (A or B or C), using a non-exclusive logical "or," however, can be contrasted to mean (A, B, and C), in addition, can be construed to mean (A and B) or (A and C) or (B and C). As used herein, the phrase "A, B and/or C" should be construed to mean (A, B, and C) or alternatively (A or B or C), using a non-exclusive logical "or."

The present invention has been described above with reference to various exemplary embodiments and examples, which are not intended to be limiting in describing the full scope of systems and methods of this invention. However, those skilled in the art will recognize that equivalent changes, modifications and variations of the embodiments, materials, systems, and methods may be made within the scope of the present invention, with substantially similar results, and are intended to be included within the scope of the present invention, as set forth in the following claims.

The invention claimed is:

1. A method for creating an experience for a child, the method comprising:

a step of obtaining an experience kit comprising:

a first set of instructions;

a craft kit comprising a plurality of interconnecting parts configured to produce at least one three-dimensional model;

a gift for the child;

a second set of instructions;

a mailing container;

a certificate of completion of the experience; and a displayable object signifying completion of the experience;

a step of understanding the first set of instructions outlining how to create the experience;

a step of delivering the experience kit to the child;

a step of reading the second set of instructions with the child, wherein the second set of instructions outlines how to build the craft kit;

a step of building with the child one or more of the models;

a step of delivering to the child the certificate of accomplishment;

a step of delivering to the child the displayable object to symbolize accomplishment;

a step of packaging at least one completed three-dimensional model into the mailing container;

a step of placing the mailing container in a location for delivery to a third person, wherein the mailing container contains the at least one completed three-dimensional model; and a step of sending the mailing container to the third person.

2. The method according to claim 1, further comprising a step of downloading digitally formatted content and having the child participate with the content on an electronic device.

3. The method according to claim 1, further comprising a step of delivering to the child a first character communication to frame the experience and to begin the experience, wherein the step of delivering the first character communication is after the step of delivering the experience kit to the child.

4. The method according to claim 3, further comprising a step of delivering to the child a second character communication to laud accomplishment on the child and to end the experience, wherein the delivering of the second character communication is before or simultaneously with at least one of the step of delivering the certificate and the step of delivering the displayable object.

* * * * *